United States Patent [19]

Suhr et al.

[11] 4,401,023

[45] Aug. 30, 1983

[54] WORM PRESS

[75] Inventors: Günther Suhr; Manfred Knuth; Wilhelm Malchow; Thorsten Homann, all of Hamburg, Fed. Rep. of Germany

[73] Assignee: Fried. Krupp GmbH, Essen, Fed. Rep. of Germany

[21] Appl. No.: 281,345

[22] Filed: Jul. 8, 1981

[30] Foreign Application Priority Data

Jul. 12, 1980 [DE] Fed. Rep. of Germany ..... 3026477

[51] Int. Cl.[3] ..... B30B 5/00; B30B 9/12

[52] U.S. Cl. ..... 100/148; 100/93 S; 100/117; 100/150

[58] Field of Search ..... 100/145, 146, 147, 148, 100/149, 150, 117, 93 S; 366/78, 79, 90

[56] References Cited

U.S. PATENT DOCUMENTS

| | | | |
|---|---|---|---|
| 2,687,084 | 8/1954 | Bowman | 100/117 X |
| 2,970,341 | 2/1961 | Mallory et al. . | |
| 3,092,017 | 6/1963 | French et al. | 100/150 X |
| 3,246,597 | 4/1966 | Burner | 100/145 |
| 3,518,936 | 7/1970 | Bredeson | 100/117 |
| 3,780,994 | 12/1973 | Kneller et al. | 100/148 X |
| 3,877,365 | 4/1975 | Berggren | 100/117 |

FOREIGN PATENT DOCUMENTS

| | | |
|---|---|---|
| 1145787 | 3/1963 | Fed. Rep. of Germany . |
| 2237190 | 2/1974 | Fed. Rep. of Germany . |
| 2751703 | 5/1979 | Fed. Rep. of Germany . |
| 1361831 | 4/1964 | France . |
| 7832085 | 6/1979 | France . |
| 1376265 | 12/1974 | United Kingdom . |
| 272248 | 9/1970 | U.S.S.R. . |
| 248962 | 10/1972 | U.S.S.R. . |

*Primary Examiner*—Peter Feldman

*Attorney, Agent, or Firm*—Karl F. Ross; Herbert Dubno

[57] ABSTRACT

A worm press, especially for pressing vegetable matter, e.g. in the pressing of oil from oil-bearing seeds and fruits, comprises a worm having a plurality of worm sections and a housing within which the worm rotates and which is formed with rings defining axially spaced constrictions for the pressed mass between the worm sections. The worm has annular frustoconical shoulders juxtaposed with frustoconical flanks of the respective rings so that the flanks of each ring and shoulder define a respective constriction which is of a width adjustable by relative axial displacement of the worm and the housing, the rings being fixed in the housing and the shoulders being fixed on the worm.

5 Claims, 3 Drawing Figures

WORM PRESS

FIELD OF THE INVENTION

Our present invention relates to a worm or screw press and particularly to a multiple-stage worm or screw press for pressing, plastifying, masticating and, if desired, heat treating materials such as vegetable matter, e.g. in the pressing of oil-bearing seeds, nuts or fruit to extract oil therefrom.

BACKGROUND OF THE INVENTION

In many industries and particularly in the pressing of oil from vegetable matter, it is common practice to make use of worm or screw presses which can have a generally cylindrical chamber formed in an elongated housing which may be provided with heating and/or cooling means, and a worm rotatable in this housing and provided with at least one and preferably a plurality of helical ribs or flights which are capable of displacing material from an inlet end of the passage to the discharge ends thereof while masticating, plastifying, compressing and frictionally treating the material.

For example, the worm may be defined axially into a plurality of sections with different flight pitches, root diameters or numbers of helical flights or ribs, thereby ensuring axial compression as the material is forced past a discharge constriction at the end of the passage. The relative movement between the mass of material and the flights for other portions of the worm and between the mass and the walls of the chamber, subject the material to shearing action which assists in homogenizing the mass.

The housing or cylindrical shell may be heated, e.g. by heating jackets and heating fluids or electrical heating means, if the compression, mastication and homogenization is to be accompanied by a heat treatment. The shell can be provided with passages, coils or the like, traversed by a coolant if sensitive materials are to be treated and the friction heat and compression heat must be abstracted.

It has been found to be advantageous, when such presses are used for the pressing of vegetable matter and for solid/liquid separation, e.g. as is the case in the pressing of oil for vegetable matter, to provide one or mre constrictions along the path of the material from one end of the passage to the other.

Therefore each constriction is conventionally formed by a ring mounted on the housing and having an inwardly turned frustoconical flight which confronts an outwardly directed frustoconical flank on an annular shoulder of the worm.

A worm press of the aforedescribed type is illustrated and discussed in German patent document No. 1,944,642 which indicates that the adjustability of the constriction gap can be a function of relative axial displacement of the two members, i.e. the ring or the shoulder forming this gap.

In this system, the housing and the worm are both axially fixed and the adjustability is provided by mounting the worm so that it can be displaced axially by an appropriate drive mechanism, on the housing.

With this system however, a problem arises with respect to sealing the passage in the region of the axially displaceable ring under the high pressures which may be generated in the pressing passage.

Even with the best of seals known to date, some discharge past the seals unavoidably occurs.

The constriction of this arrangement is expensive, is frequently unreliable and requires high maintenance costs.

OBJECTS OF THE INVENTION

It is the principal object of the present invention to provide an improved worm press, especially for the aforedescribed purposes, which can enable adjustment of the constriction of the gap width economically, reliably and conveniently without disadvantages of the prior art arrangement as discussed above.

Another object of the invention is to provide a screw press particularly for the pressing of oil-bearing vegetable matter and the separation of oil from such vegetable matter whereby the sealing problems of earlier systems are obviated.

Yet another object of the invention is to provide an improved worm press which has reduced maintenance cost and less expensive construction.

SUMMARY OF THE INVENTION

These objects and others which will become apparent hereinafter are attained, in accordance with the present invention, in a worm press, especially for the compression of vegetable materials and for solid/liquid separation, e.g. in the pressing of oil from the vegetable matter, which comprises an elongated generally cylindrical housing or shell defining an elongated pressing passage or chamber, a worm received in and rotatable relative to this passage or chamber and formed with at least one generally helical flight over at least one axial section of the worm for displacing the material from one end of the passage to the other while compressing the material, at least one constriction-forming ring on the housing having an inwardly turned frustoconical flank and at least one constriction-forming outwardly turned flank on the worm juxtaposed with the ring and defining a constriction or gap therewith.

According to the invention, the throttling ring is fixed in the press shell or housing and the throttling shoulder is fixed on the worm so as to be axially immobile relative to the remainder of the worm, the displaceability between the ring and the shoulder being ensured by mounting the seal and the worm to be relatively axially displaceable as a whole and providng means for the axial displacement of one of the members, i.e. the shell or the worm.

Thus, when the shell is fixed, the worm can be axially displaceable whereas, when the worm is fixed, the shell can be axially displaceable, or both may be made axially displaceable relative to a support.

With the system of the invention, a seal of two relatively displaceable members against the high press pressure at the constriction or throttle location does not pose a problem because the ring does not move relative to the remainder of the housing nor is the shoulder shiftable relative to the balance of the worm.

The seals between the housing and the worm can be provided in pressureless regions, i.e. beyond the outlet of the passage and upstream of the inlet thereof.

However, it may be noted that a seal at the outlet end may not be required in any event because at this end a freely open gap is provided between the worm and the press shield.

The invention is applicable not only to worms with two treatment sections separated by a single throttle.

When the screw is formed with a multiplicity of sections, a respective throttle can be provided between each pair of sections and the relative displacement of the worm and the shell can simultaneously adjust the widths of all of the throttles.

When the throttling action is to differ at the various throttles, the latter may be originally given different shapes or gap widths so that the difference in action is maintained even as the relative displacement adjusts all of the throttles.

In accordance with the principle of the invention that sealing locations should be located in pressureless zones or in regions of low pressure, it has been found to be advantageous to provide the abutment or parting surfaces between the members forming the worm at least in part in the regions directly following a throttle region because these regions are at relatively low pressure. These abutting surfaces are thus not subjected to elevated pressures and to the corrosion conditions associated with high press pressures and the problems associated with disassembling the worm to replace worm parts thereof are reduced.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
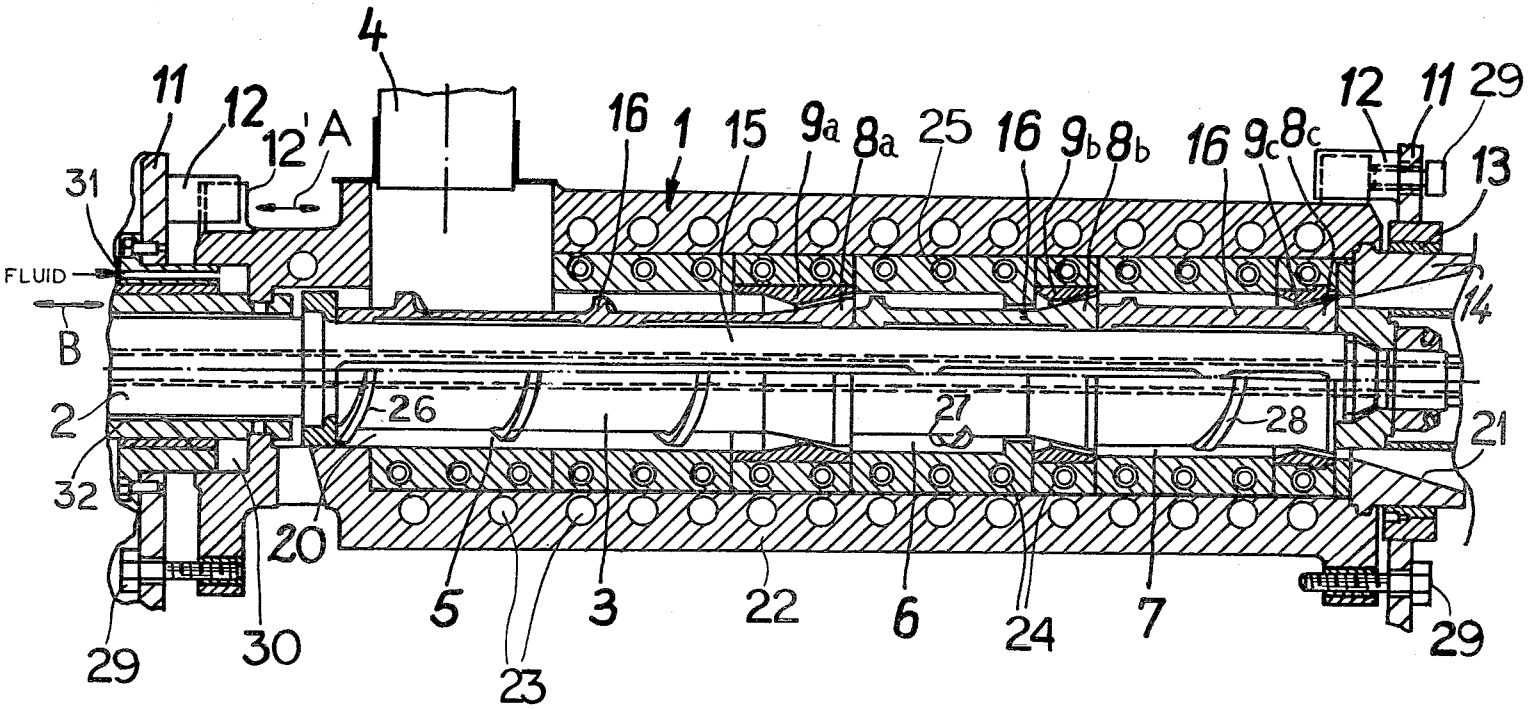
FIG. 1 is an axial cross-sectional view, in highly diagrammatic form through a worm press embodying the present invention.

FIG. 1 shows a press housing or shell 1 which is formed with an elongated passage or chamber 20 subdivided axially into the pressing sections 5, 6, 7 by a pair of axially spaced throttles or constrictions and separated from the outlet 21 by a further throttle or constriction as will be discussed in greater detail below. The housing or shell 1 is provided with an outer jacket 22 which can be formed with passages 23 for a cooling fluid, the outer member 22 being lined internally by members 24 which are provided with electrical heating coils 25. At the left hand end of the housing, an inlet opening 4 communicates with the passage for delivering vegetable matter to be pressed thereto. The pulp is discharged at 21.

A rotary worm 3 provided with a drive shaft 2 is disposed within the passage 20 and carries flights 26, 27 and 28 in the form of helical ribs which, upon rotation of the worm, displace the material to the right.

The throttles at the transitions between the sections 5, 6, 7, each comprise a frustoconical throttle shoulder 8*a*, 8*b* or 8*c* mounted upon the worm 3 and a throttle ring 9*a*, 9*b* or 9*c*, mounted in the press shell 1.

Figure 2:
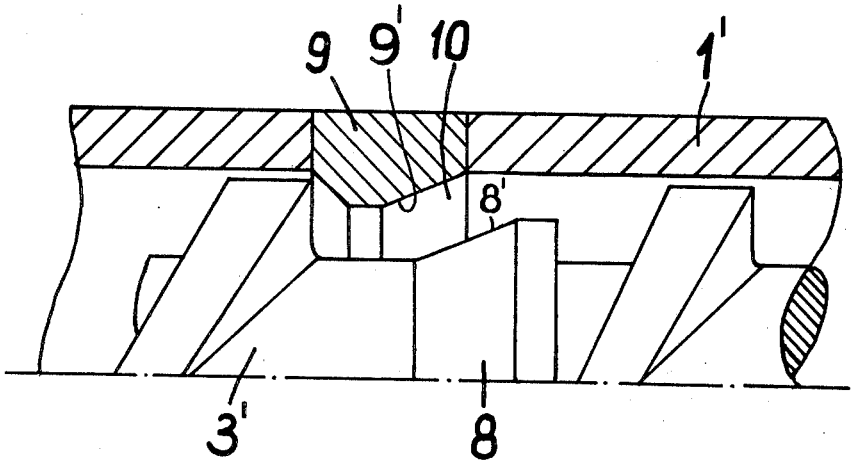
FIG. 2 is a diagrammatic section of a throttle region showing the throttle position for a large width.
Figure 3:
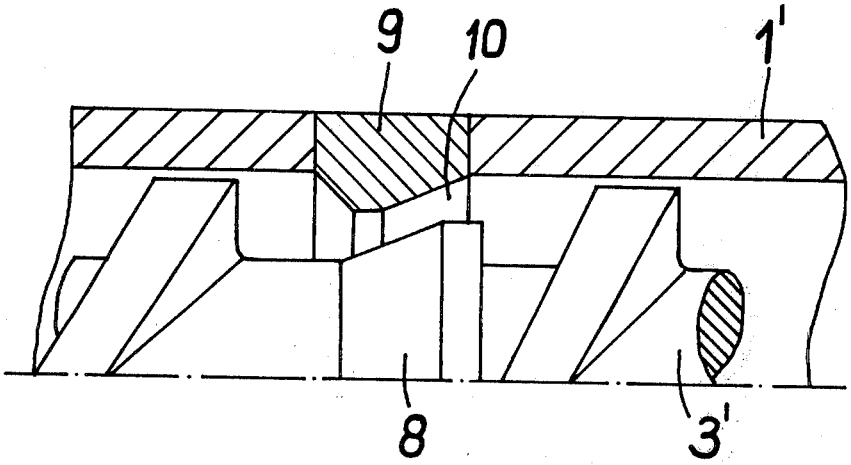
FIG. 3 is a section corresponding to that of FIG. 2 showing the same portion of the press with the throttle adjusted for a small width.

In FIGS. 2 and 3, a typical ring has been shown at 9 in the shell 1 and can be seen to be roof-shaped in cross section, having a frustoconical flank 9' confronting a frustoconical flank 8' on the shoulder 8 forming part of the worm 3'.

The gap 10 can have a greater width (FIG. 2) or lesser width (FIG. 3) depending upon the relative axial positions of the shell and the worm.

In accordance with the present invention, the rings 9*a*–9*c* are fixed to the shell while the shoulders 8*a* through 8*c* are fixed to the worm and the adjustment of the throttle gap width is effected by relative axial displacement of the shell and the worm as represented by the arrows A and B in FIG. 1.

For adjustment of the gap width, for example, the shell or housing 1 can, assuming the shaft 2 and the worm 3 to be axially fixed, be provided between walls 11 of a fixed press housing and can be axially shiftable relative thereto. For example, the walls 11 can have axial projections 12 which engage radial lugs 12' at the opposite ends of the housing 1 so that relative angular displacement of the housing and these walls is not permitted. Adjusting screws 29, however, permit the housing to be shifted to the right or to the left thereby adjusting the gap widths.

Of course, when manual adjustment via the screws is not desirable, we may pressurize a compartment 30 via a passage 31 to provide hydraulic displacement of the housing 1 to the right or to the left. The housing is here connected to a sleeve 32 which can shift axially while forming a bearing for the shaft 2. In this case, the screws 29 can be dispensed with.

The axial displacement of the housing 1 simultaneously adjusts the widths of all of the throttle gaps.

The housing 1 is formed at its discharge end by a bearing 13 fixed to the housing and receiving the discharge cone 14 which radially centers the housing end. At the inlet side, the bearing sleeve 32 centers the housing end relative to the worm 3.

The wrom 3 is formed by a throughgoing core 15 and sleeves 16 slid axially onto the core and with abutment surfaces or joints lying directly ahead of respective throttles whereby these joints are relieved from pressure.

We claim:

1. A worm press comprising:

an elongated housing disposed between two walls and forming a pressing chamber extending along an axis from an inlet end to an outlet end;

an axially fixed worm extending axially in said chamber and rotatable relative to said housing, said worm comprising at least two axially spaced sections each formed with a respective worm flight;

a throttle ring fixed in said housing between said sections;

a throttle shoulder fixed on said worm between said sections, said ring having an inwardly directed frustoconical flank and said shoulder having an outwardly directed frustoconical flank juxtaposed with said inwardly directed frustoconical flank and defining a throttle gap therewith; and means for relatively axially displacing said housing and said worm to adjust the width of said gap, a plurality of throttle gaps being provided in axially spaced relationship between said inlet and outlet ends, each of said throttle gaps being formed by a respective ring fixed in said housing and a respective annular shoulder fixed on said worm with each ring and the respective shoulder having juxtaposed frustoconical surfaces, said means for relatively axially displacing said housing and said worm including means on said walls and said ends of said housing for axially shifting said housing between said walls while preventing rotation of said housing about said axis.

2. The worm press defined in claim 1 wherein all of said throttle gaps being arranged to have their widths simultaneously adjusted by relative displacement of said housing and said worm.

3. The worm press defined in claim 2 wherein said throttle gaps have widths differing from one another.

4. The worm press defined in claim 2 wherein said throttle gaps have shapes differing from one another.

5. The worm press defined in claim 2 wherein said worm is composed of a plurality of sections forming joints each disposed downstream of a respective throttle gap whereby said joints are exposed to lesser pressures than the regions upstream of the respective throttle gaps.

* * * * *